US005551577A

United States Patent [19]

Hagopian

[11] Patent Number: 5,551,577

[45] Date of Patent: Sep. 3, 1996

[54] MERCHANDISE DISPLAY SYSTEM

[75] Inventor: Gerald M. Hagopian, Oak Creek, Wis.

[73] Assignee: KCS Industries Inc., Milwaukee, Wis.

[21] Appl. No.: 325,801

[22] Filed: Oct. 19, 1994

Related U.S. Application Data

[63] Continuation-in-part of Ser. No. 305,039, Sep. 13, 1994.

[51] Int. Cl.[6] ..... E05B 73/00

[52] U.S. Cl. ..... 211/4; 211/40; 211/41; 211/96

[58] Field of Search ..... 211/48, 96, 40, 211/41, 4, 7, 94.5, 169

[56] References Cited

U.S. PATENT DOCUMENTS

| | | | |
|---|---|---|---|
| 2,740,528 | 4/1956 | Kaiser | 211/4 |
| 3,674,156 | 7/1972 | Krebs | 211/4 |
| 3,760,952 | 9/1973 | White | 211/4 |
| 3,785,499 | 1/1974 | Gedye | 211/4 |
| 4,584,950 | 4/1986 | Adams et al. | 211/41 |

FOREIGN PATENT DOCUMENTS

| | | | |
|---|---|---|---|
| 1459996 | 12/1976 | United Kingdom | 211/4 |

*Primary Examiner*—Karen J. Chotkowski
*Assistant Examiner*—Gwendolyn Wrenn
*Attorney, Agent, or Firm*—Foley & Lardner

[57] ABSTRACT

A merchandise display system includes a support structure; at least one display bar mounted substantially vertically on the support structure and a plurality of merchandise holders or enclosures disposed in a column along the display bar. Each enclosure includes an end portion having a bore for receiving the display bar and a display portion extending from the end portion and having a bottom panel, side walls and an open upper end. Each holder or enclosure further includes a retaining member configured to engage an adjacent enclosure in the column and permit alignment of the enclosures. The retaining member may be a peripheral flange extending around the bottom of the enclosure, permitting nesting of enclosures in the column. Each enclosure is pivotable about the display bar between a first position wherein the enclosure is aligned with at least one adjacent enclosure, thereby preventing removal of merchandise, and a second position wherein the enclosure is angularly displaced with respect to at least one adjacent enclosure, thereby permitting removal of merchandise. When the retaining member is a peripheral flange, an enclosure is vertically displaced along the display bar before being pivoted to its second position. A locking assembly may be provided to prevent displacement of enclosures along the display bar.

20 Claims, 6 Drawing Sheets

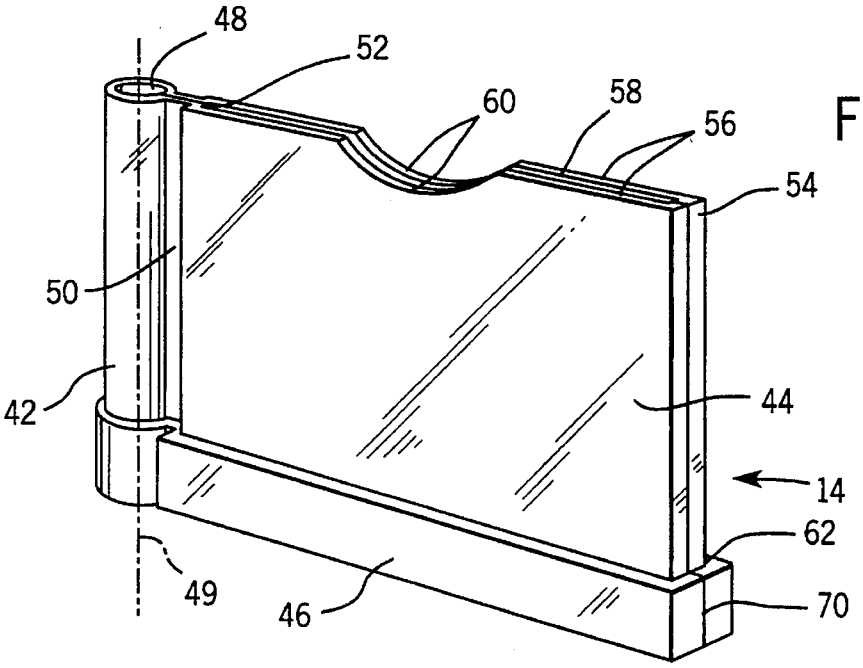
FIG. 3
FIG. 4
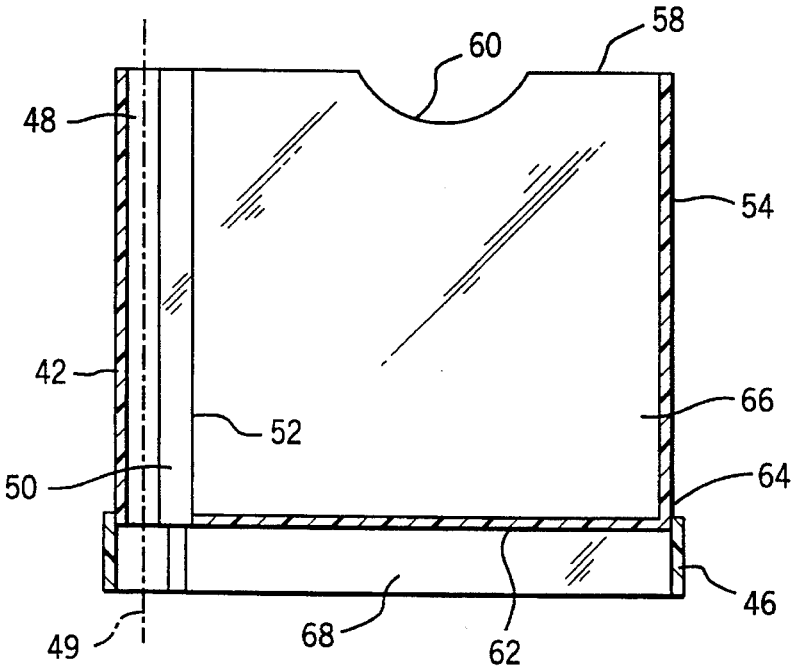
FIG. 5
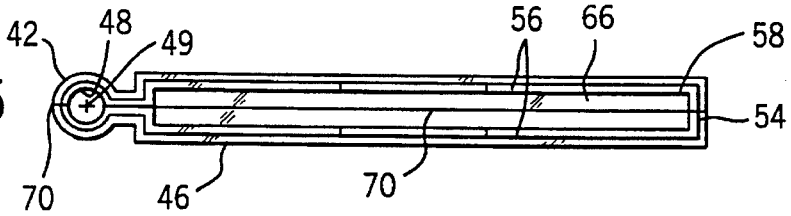

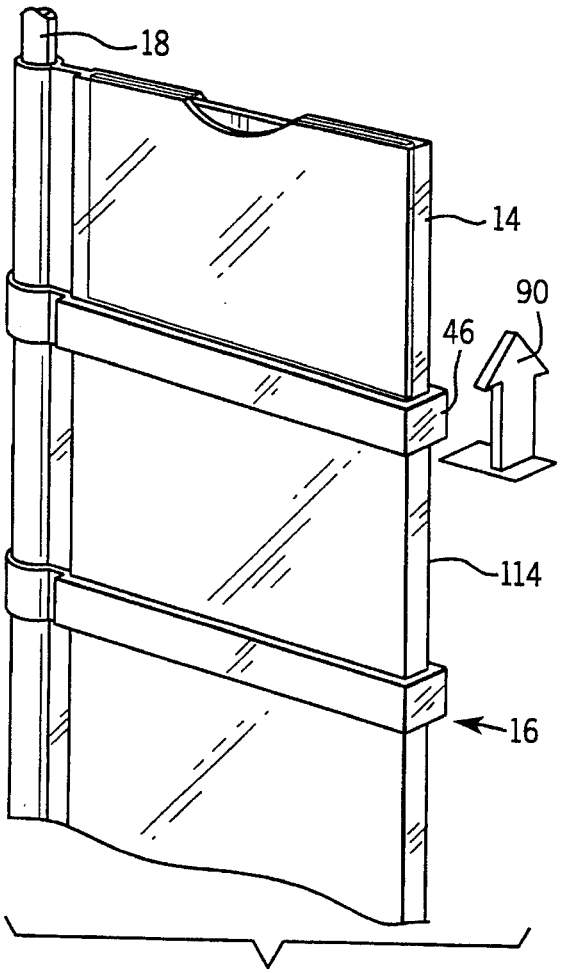
FIG. 7
FIG. 8
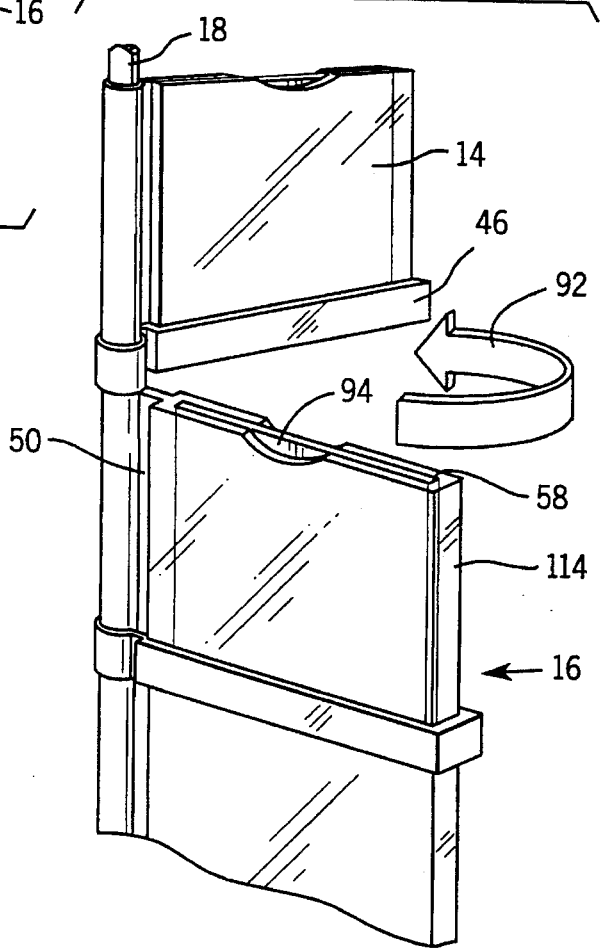

MERCHANDISE DISPLAY SYSTEM

This is a continuation-in-part of co-pending U.S. patent application Ser. No. 08/305,039 filed Sep. 13, 1994.

BACKGROUND OF THE INVENTION

The present invention relates generally to a merchandise display system. More particularly, the present invention relates to a system for displaying merchandise in regularly shaped enclosures of the same or similar configuration. The system is particularly suitable for displaying merchandise such as compact discs, cassettes and computer software in a retail setting.

A constant challenge for retail sales establishments is the effective display of merchandise to the buying public. The system should be simple, attractive and permit the merchandise to be displayed in an organized fashion. Moreover, such systems should allow customers to examine merchandise sufficiently to make a decision to buy, should be adaptable for protecting the merchant against pilferage and should be relatively space-efficient to allow a merchant to display as much product as possible per unit of sales area. Where such systems rely on locking mechanisms to restrict access to the merchandise, these mechanisms must be susceptible to quick and easy opening and closing by sales personnel.

A number of products pose problems in this regard, particularly merchandise packaged in relatively regular enclosures such as compact discs, music cassettes and computer software. While a number of systems have been proposed or adapted for the display for sale of such products, no system has satisfactorily fulfilled the criteria mentioned above. Such products are often displayed in open-access display stands, providing little or no security against pilferage and limiting the number of titles that potential buyers can view simultaneously. In other known display systems, locking showcases are provided with openings small enough to prevent removal of merchandise, while still permitting buyers to insert their hands into the cases to handle and examine the merchandise. Such showcases are often heavy and bulky and require that the entire case be opened for organizing and restocking merchandise. In another known approach, particularly adapted to the display of regularly shaped packages such as for compact discs, music cassettes and computer software, each item of merchandise is placed in a larger plastic or paper package that can be displayed in large open bins. Where the product is packaged in a paper box, a large quantity of waste paper is generated that is simply discarded by the buyer. However, where no such packaging or display case is used, the risk of significant loss by pilferage increases.

The present invention is directed to overcoming or minimizing the drawbacks of known display techniques. In particular, the invention is directed to a display system that allows the buying public to view and examine merchandise, while offering considerable security to merchants.

SUMMARY OF THE INVENTION

The present invention features a novel display system permitting merchandise to be displayed in columns of pivotable merchandise holders. The holders in each column may be retained in an aligned position for preventing removal of merchandise and pivoted with respect to at least one adjacent holder in the column to permit removal of merchandise. Thus, in accordance with a first aspect of the invention, there is provided a merchandise display system including a support structure, at least one elongated display bar mounted substantially vertically on the support structure and a plurality of merchandise holders disposed in a column along the display bar. Each merchandise holder includes a substantially cylindrical end portion having an opening for receiving the display bar therethrough, a display portion extending substantially perpendicularly from the end portion and a retaining member. The display portion has substantially vertical sides for receiving and holding merchandise. The retaining member is configured to engage an adjacent holder in the column for maintaining alignment of the holders in the column. Each merchandise holder is pivotable between a first position wherein the holder is aligned with at least one adjacent holder in the column, thereby preventing removal of merchandise, and a second position wherein the holder is angularly displaced with respect to at least one adjacent holder in the column, thereby permitting removal of merchandise.

Other aspects of the present invention feature a novel merchandise display system including a support frame, at least one display bar disposed substantially vertically on the support frame and a plurality of display enclosures disposed in a column along the display bar. Each display portion has a hollow end portion for receiving the display bar therethrough, a merchandise display portion coupled to the end portion and extending substantially horizontally therefrom and a retaining member. Each display portion includes substantially vertical walls surrounding an internal display space and an open upper end for inserting merchandise into the display space and removing merchandise therefrom. Each retaining member extends from the respective enclosure and is configured to engage an adjacent enclosure in the column, thereby permitting the enclosures to be nestingly stacked. Each enclosure is pivotable between a first position wherein the enclosure is nested with at least one adjacent enclosure in the column, thereby preventing removal of merchandise, and a second position wherein the enclosure is angularly displaced with respect to at least one adjacent enclosure in the column, thereby permitting removal of merchandise.

In accordance with another aspect of the invention, a merchandise display enclosure includes an end portion, a display portion and a retaining member. The end portion has a substantially vertical, cylindrical bore for receiving a support bar therethrough and maintaining the enclosure pivotally on the support bar. The display portion extends substantially horizontally from the end portion and has a bottom and sides surrounding an internal display space, and an open upper end for receiving merchandise into the internal display space and removing merchandise therefrom. The retaining member is configured to engage a similar display enclosure to permit alignment of display enclosures along the support bar.

BRIEF DESCRIPTION OF THE DRAWINGS

The present invention will become more fully understood from the following detailed description, taken in conjunction with the accompanying drawings, wherein like reference numerals refer to like parts, in which:

FIG. 3 is a perspective view of a preferred display enclosure for use in the display system of FIG. 1;

FIG. 4 is a sectional view of the display enclosure of FIG. 3;

FIG. 5 is a top view of the enclosure of FIG. 3 illustrating the dimensional relationship between the elements of the preferred enclosure that permit nesting of one enclosure in another;

FIGS. 7, 8, and 9 are a perspective views of a series of enclosures of the type shown in FIG. 3, illustrating sliding and pivotal movements of the enclosures affording access to the open end of one of the enclosures for inserting or removing merchandise.

DESCRIPTION OF THE PREFERRED EMBODIMENTS

Before beginning the detailed description of the preferred embodiments, several general comments will assist in understanding the scope of the invention.

First, the present display system is particularly suited for display of merchandise packaged in regularly shaped containers, such as compact discs, cassettes and computer software. In the most preferred embodiment illustrated and described below, such merchandise is inserted in an open-topped merchandise holder and a number of such holders are stacked in a column along a display bar. A number of such display bars may be included in a single display system. The height of the merchandise holders is preferably at least equal to the height of the merchandise to be displayed therein, such that the holders form display enclosures that may be nestingly aligned one atop another in the columns. Alternatively, however, the holders could be shorter than the merchandise, such that merchandise is retained in the holders without being completely encased.

Secondly, each holder or enclosure in the present display system includes a retaining member designed to contact an adjacent enclosure when the enclosures are aligned in a column along a display bar. In the presently preferred embodiment, this retaining member is a peripheral flange that extends downwardly around the entire enclosure. This flange has internal dimensions slightly greater than the external dimensions of the enclosure, permitting a lower enclosure to be nested within the flange of an adjacent upper enclosure. However, the invention is intended to cover systems as described below incorporating alternative embodiments of this retaining member. For example, a peripheral flange may be provided at the upper end of each enclosure or the peripheral flange may be discontinuous or even reduced to alignment projections designed to contact and retain an adjacent enclosure. Moreover, the retaining member may include a detent or a resilient latch designed to cooperate with a corresponding indentation in an adjacent enclosure.

Finally, while the merchandise holders or enclosures described below may be made of any suitable material, they are preferably made of a transparent moldable plastic material. Moreover, the enclosures may be fabricated in multiple pieces, such as two mirror-image sides, that are later firmly joined adhesively, by sonic welding or other suitable technique.

Figure 1:
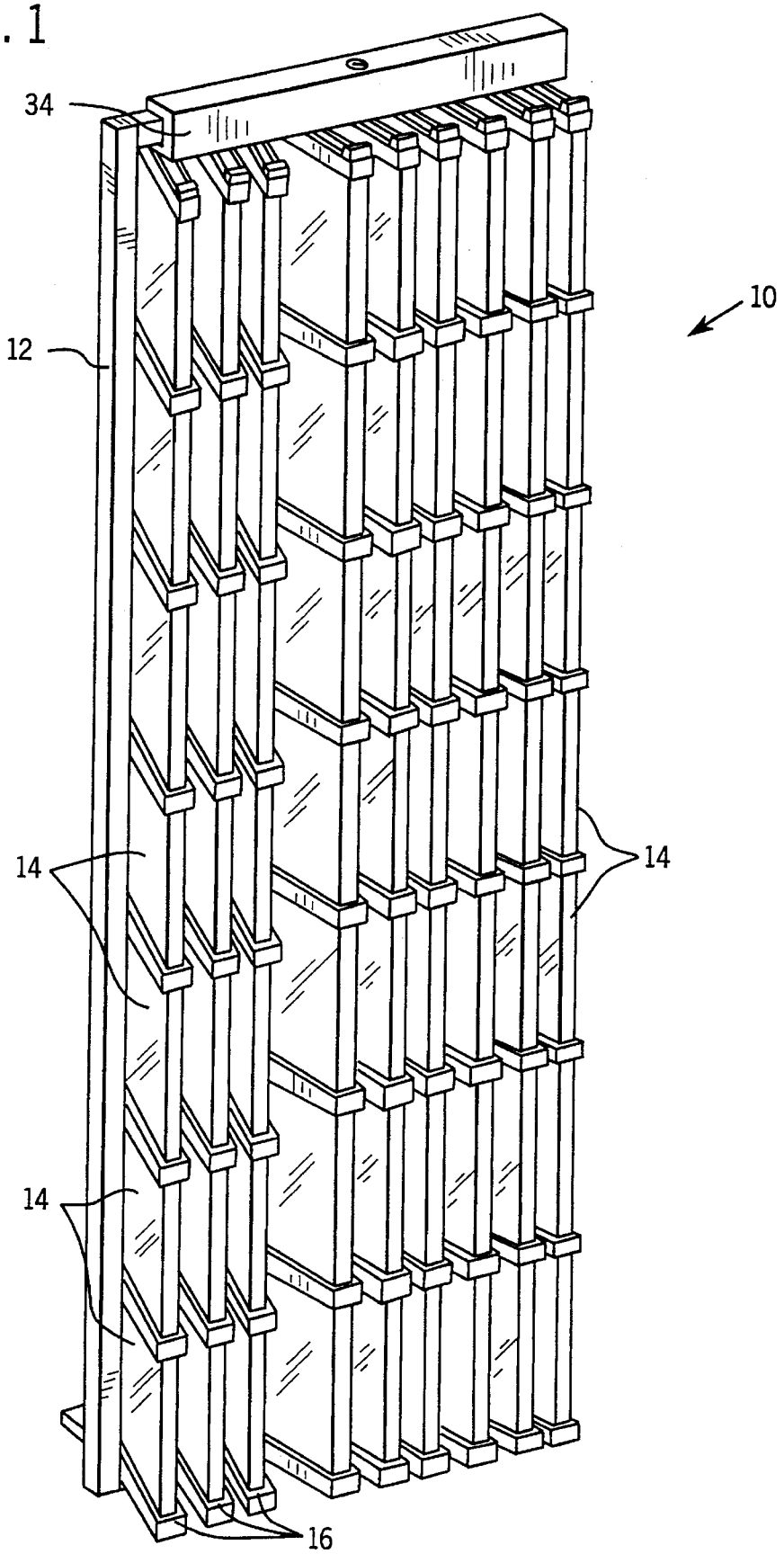
FIG. 1 is a perspective view of a preferred embodiment of a display system in accordance with the present invention.
Figure 2:
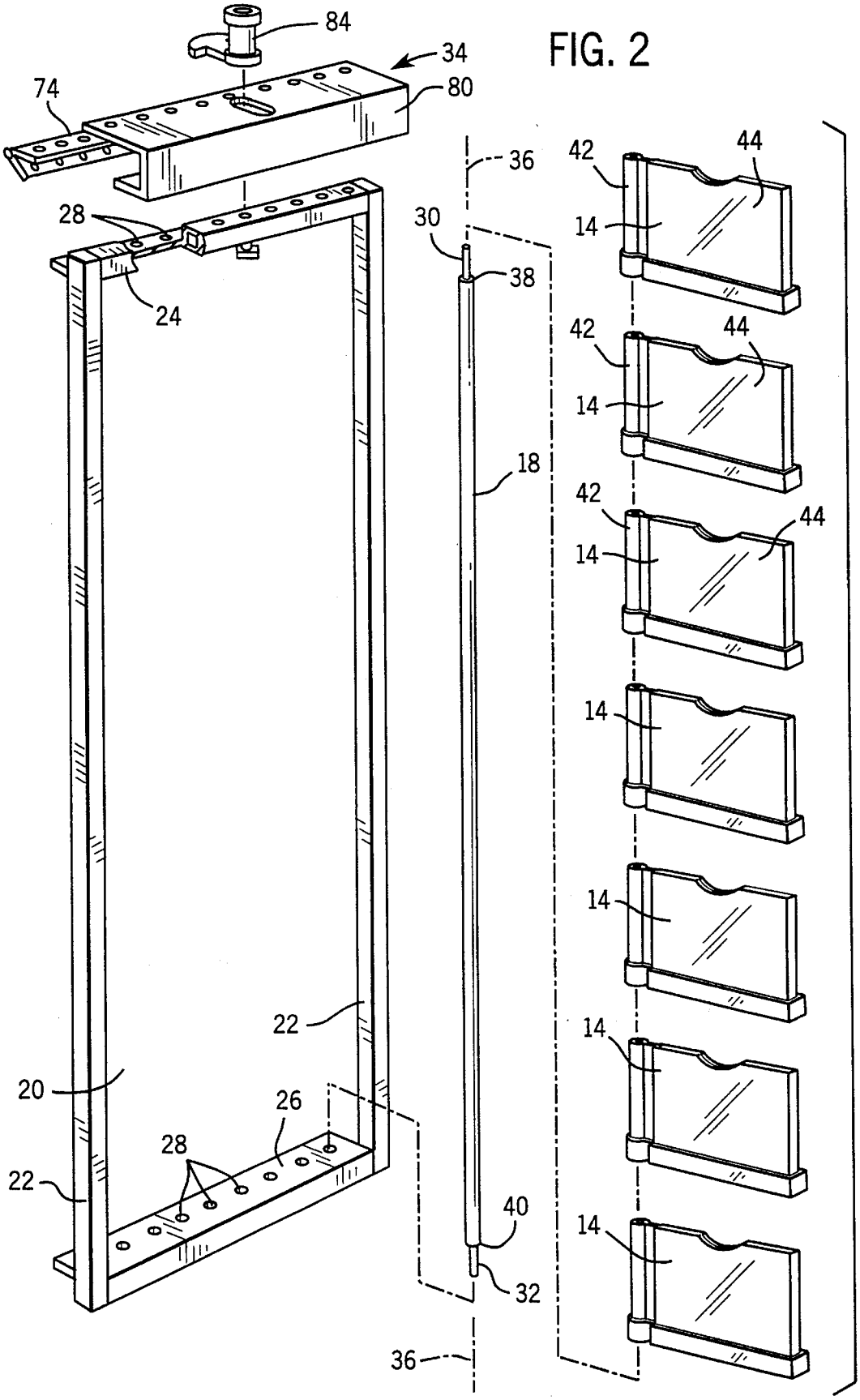
FIG. 2 is an exploded perspective view of the display system of FIG. 1 showing how display enclosures are stacked on a display bar for mounting in a support structure.

Turning now to the drawings and referring to FIGS. 1 and 2, a display system 10 is illustrated as including a support structure or framework 12, a plurality of merchandise holders or enclosures 14 disposed in columns 16 on display bars 18 (one such display bar is illustrated in FIG. 2). In the embodiment illustrated in the FIGURES, support structure 12 is a rectangular frame having a central aperture 20 surrounded by sides 22 and upper and lower members 24 and 26. Upper and lower members 24, 26 include mounting apertures 28 for receiving and supporting upper and lower ends 30 and 32 of display bars 18. Support structure 12 may be secured to a wall or other fixed support in a retail establishment or system 10 may be used as a free-standing unit by attaching suitable legs or a base (not shown) to sides 22 or lower member 26. Display system 10 may include a locking assembly 34 mounted atop upper member 24 for selectively preventing access to merchandise displayed in columns 16 as will be described in greater detail below.

Display bar 18 is preferably a solid metal shaft having a circular cross-section extending along a longitudinal axis 36. Upper and lower ends 30 and 32 are of reduced diameter whereby upper and lower shoulders 38 and 40 are formed on display bar 18. Shoulders 38 and 40 effectively limit movement of bar 18 in support structure 12 when ends 30 and 32 are fitted into apertures 28 during assembly of display system 10. As illustrated in FIG. 2, each merchandise holder or enclosure 14 includes a hollow end portion 42 preferably cylindrical, and a display portion 44. End portions 42 of enclosures 14 receive display bar 18 therethrough such that a number of enclosures 14 may be stacked in a column 16 along display bar 18. Moreover, each enclosure 14 includes a retaining member 44 configured to engage an adjacent enclosure 14 in the assembled system and thereby maintain alignment of enclosures 14 in column 16. Each column 16 of display enclosures 14 is mounted on support structure 12 by first inserting upper end 30 into a mounting aperture 28 in upper member 24, aligning lower end 32 above a corresponding mounting aperture 28 in lower member 26 and lowering display bar 18 until shoulder 32 contacts lower member 26. Thus installed in support structure 12, display bar 18 and end portions 42 of enclosures 14 disposed thereon extend substantially vertically, while display portions 44 extend substantially horizontally from their associated end portions 42.

In addition to supporting display bar 18, upper and lower ends 30 32 and upper and lower shoulders 38, 40 serve as bearings, permitting pivotal movement of display bar 18 about axis 36. In addition, enclosures 14 are pivotable on display bar 18 about axis 36. Once merchandise is placed in enclosures 14 as will be described below, this arrangement permits potential buyers to leaf through columns 16 of merchandise by pivoting each column 16 about the axis 36 of the display bar 18 on which the column is supported.

The preferred embodiment of display enclosures 14 will now be described with reference to FIGS. 3 through 6. Enclosure 14 includes an end portion 42, a display portion 44 and a retaining member 46. End portion 42 preferably comprises a circular cylinder surrounding an opening or bore 48 extending along a central axis 49. Bore 48 completely traverses end portion 42 to form an open-ended tubular structure. A lateral extension 50 connects end portion 42 to display portion 44 and serves to support display portion 44 on end portion 42. Display portion 44 includes a rear side secured to lateral extension 50, a front side 54 spaced from and facing rear side 52 and mutually facing, spaced-apart lateral faces or sides 56 extending between rear side 52 and front side 54. Sides 52, 54 and faces 56 terminate in an open upper end 58. Arcuate recesses 60 are preferably formed in lateral faces 56 along open upper end 58.

As best illustrated in FIG. 4, enclosure 14 further includes a bottom panel 62 extending between rear and front sides 52, 54 and lateral faces 56. Back and front sides 52, 54, lateral faces 56 and bottom panel 62 surround an internal display space 66 appropriately dimensioned to receive and hold merchandise for display. Thus, when incorporated in the assembled display system 10, display enclosure 14 receives merchandise into display space 66 through open upper end 58. The merchandise is then retained by sides 52, 54, faces 56 and bottom panel 62 and can be removed through open end 58. Recesses 60 facilitate grasping merchandise positioned in enclosure 14 for removal.

In the preferred embodiment illustrated, retaining member 46 is a peripheral flange extending downwardly around a lower end 64 of enclosure 14. Retaining member 46 forms, with bottom panel 62, a lower cavity 68. Moreover, retaining member 46 fits outside end portion 42, lateral extension 50, and display portion 44 such that lower cavity 68 is slightly larger than these elements, but is similarly configured (see FIG. 5), permitting enclosures 14 to be nested when arranged in the assembled display system 10 as described below.

Enclosures 14 are preferably made of a transparent plastic material, and can be molded, such as by conventional injection molding, in one or multiple pieces. For example, enclosures 14 can be made of two mirror-image halves similar to the cross-sectioned element illustrated in FIG. 4, joined along a seam 70 by an adhesive, sonic welding or any other suitable assembly process.

Figure 6:
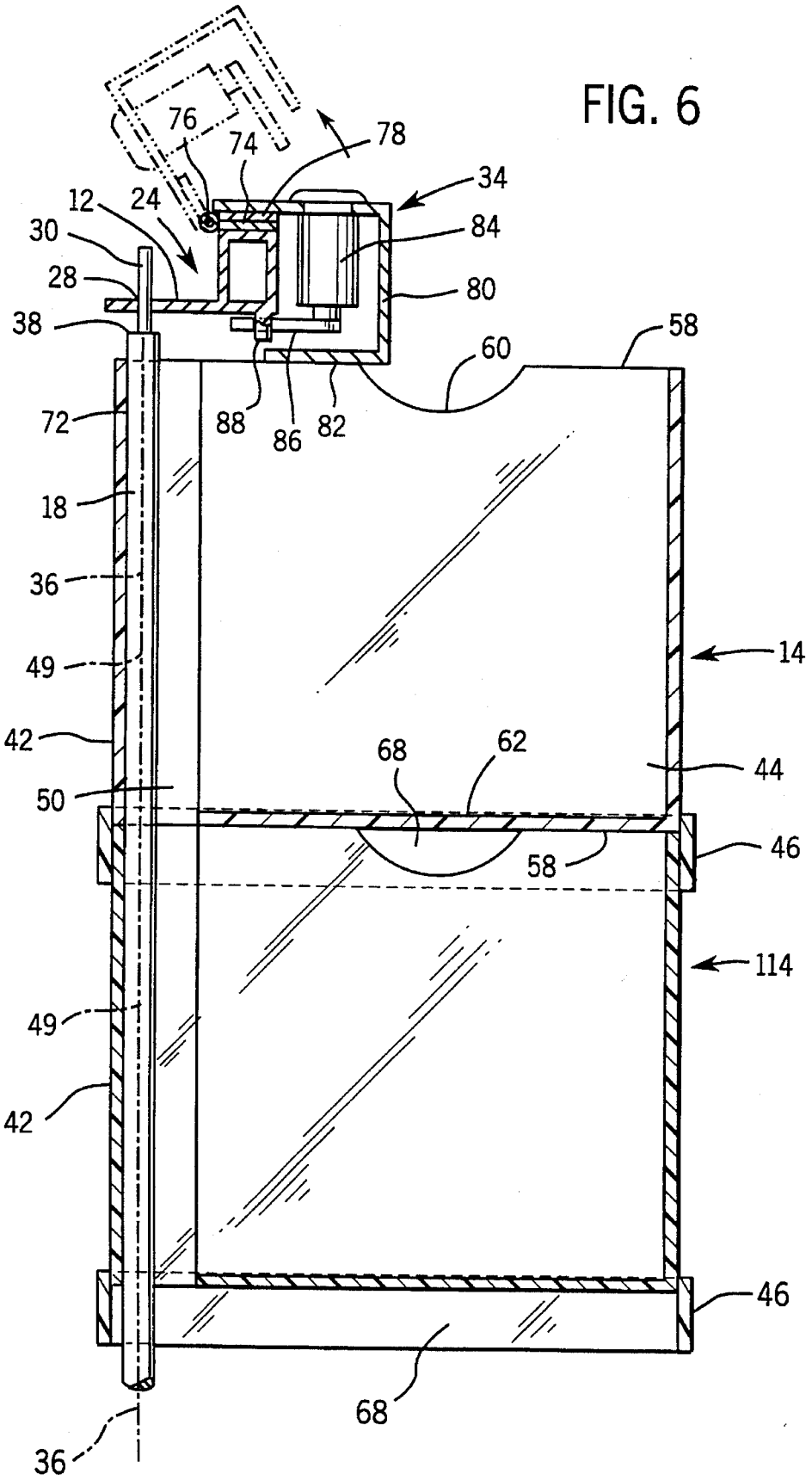
FIG. 6 is a partial sectional view of a portion of the display system of FIG. 1 illustrating the nesting alignment of the display enclosures and showing a locking device arranged to cooperate with the column of enclosures to prevent access to merchandise in the enclosures.

As illustrated in FIG. 6, in the assembled display system 10, enclosures 14 are disposed in a column 16 along display bar 18 with the axis 36 of display bar 18 generally coincident with the axes 49 of end portions 42. The inner surface 72 of each end portion 42 acts as a bearing surface for contacting display bar 18 and permitting pivotal movement of enclosure 14 on display bar 18. Moreover, in the preferred embodiment, enclosures 14 are slidable along display bar 18 for nesting and unnesting adjacent enclosures. Thus, as shown in FIG. 6, enclosure 14 may be nested with an adjacent enclosure 114 in column 16 by lowering enclosure 14 over the adjacent enclosure 114. In this nested position, open upper end 58 of the adjacent enclosure 114 fits within lower cavity 66 of enclosure 14 with retaining member 46 of enclosure 14 surrounding end 58 of adjacent enclosure 114. It will be noted that such nesting of enclosures 14, 114 in the present display system 10 provides a simple and effective method for aligning enclosures in a column 16 and prevents removal of merchandise from all but the upper-most enclosure 14.

The present display system 10 may be made secure against pilferage by inclusion of a locking assembly 34 mounted atop support structure 12 as illustrated in FIG. 6. Locking assembly 34 includes a hinge 74 secured to support structure 12 and having a horizontal hinge pin 76 about which a free end 78 may pivot. A channel-shaped locking bar 80, including a lower abutment arm 82, is coupled to free end 78 of hinge 74 and is pivotable about hinge pin 76 between a lowered or locked position (illustrated in solid lines in FIG. 6) and a raised or unlocked position (illustrated in broken lines in FIG. 6). A cylinder lock 84 of conventional design is mounted within locking bar 80 and includes a latch 86. Latch 86 may be rotated by movement of lock 84 to engage a locking pin 88 on support structure 12 to selectively prevent locking bar 80 from being pivoted from its locked position. As shown in FIG. 6, when locking bar 80 is in its locked position, abutment arm 82 is situated just above the open upper end 58 of the upper-most enclosure 14 in a column 16 of enclosures. Abutment arm 82 thus prevents the removal of merchandise from the upper-most enclosure 14. Moreover, abutment arm 82 substantially blocks vertical displacement or sliding of enclosure 14 along display bar 18. The amount any enclosure 14 can be vertically displaced along display bar 18 when locking bar 80 is in its locked position is preferably less than the height of lower cavity 68 formed by retaining member 46 and bottom panel 62, such that enclosure 14 cannot be raised sufficiently to become unnested from adjacent enclosure 114, thereby preventing removal of merchandise from all enclosures nested below upper-most enclosure 14.

Figure 9:
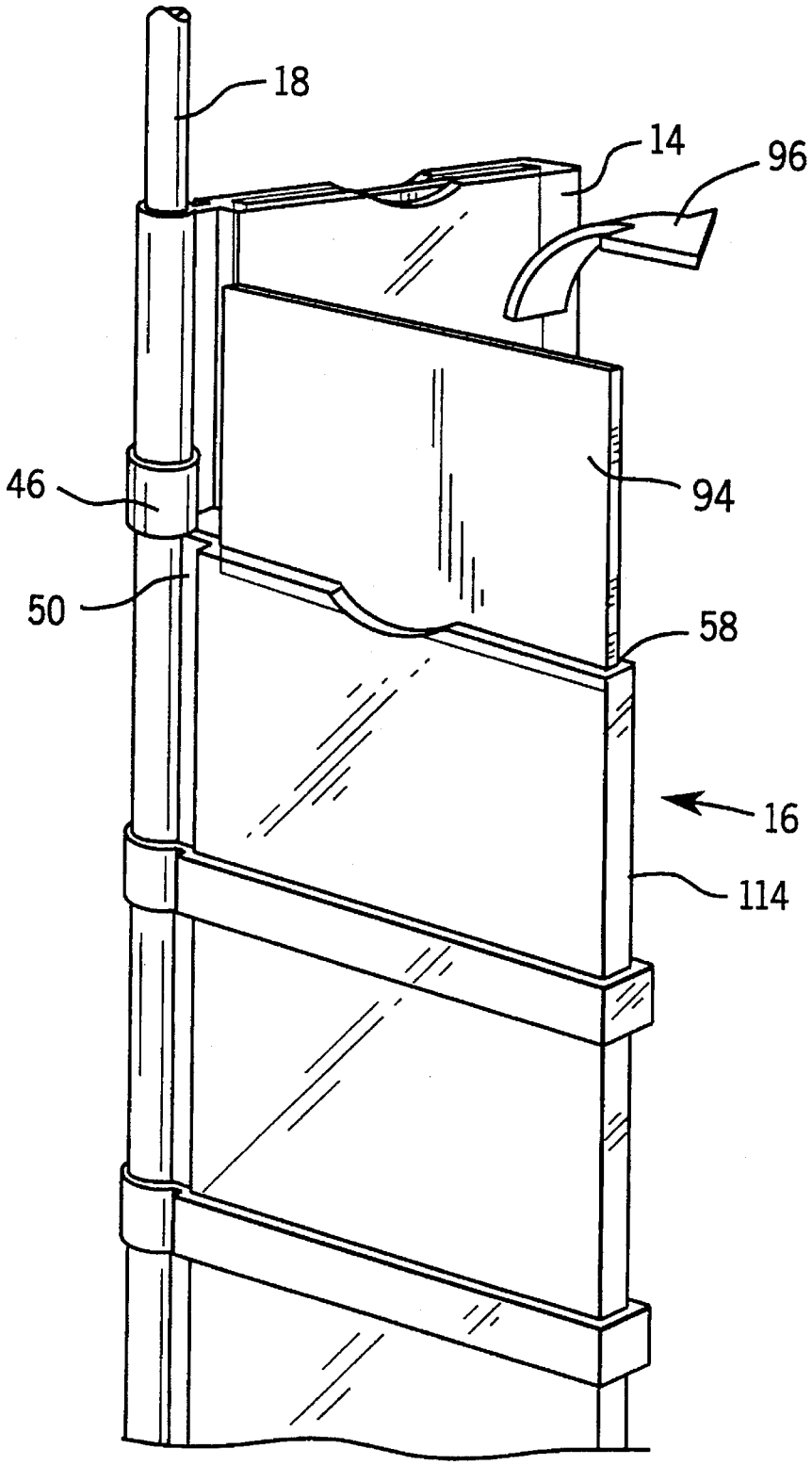

Each merchandise holder or enclosure 14 disposed in a vertical column 16 is movable between a first position wherein it is aligned with adjacent holders or enclosures 114 and a second position wherein it is angularly displaced with respect to at least one adjacent holder or enclosure. In the first position, enclosure 14 prevents removal of merchandise from the adjacent enclosure 114 immediately below it in column 16 by covering open upper end 58 of enclosure 114; whereas in the second position, open end 58 of enclosure 114 is exposed and merchandise may be freely removed from enclosure 114. Moreover, in the preferred embodiment, wherein retaining member 46 is a peripheral flange permitting nesting of enclosures in a column 16, an enclosure 14 must be raised and unnested from the adjacent enclosure 114 immediately below it in column 16 before rotation of enclosure 14 with respect to adjacent enclosure 114. This feature of the present display system is illustrated in FIGS. 7, 8 and 9.

FIG. 7 illustrates the upper-most enclosure 14 in a column 16 of enclosures in its first or aligned position. For removal of merchandise from adjacent enclosure 114, immediately below enclosure 14, enclosure 14 is first raised or slid along display bar 18 a sufficient distance to permit retaining member 46 to clear the upper end of adjacent enclosure 114, as indicated by arrow 90. Once raised to this position, enclosure 14 may be freely pivoted about display bar 18 as indicated by arrow 92 in FIG. 8. As enclosure 14 is thus pivoted, open upper end 58 of adjacent enclosure 114 is exposed providing access to merchandise 94 positioned therein. As enclosure 14 is further pivoted to its second position illustrated in FIG. 9, open upper end 58 of adjacent enclosure 114 is completely exposed and merchandise 94 may be raised and removed as indicated by arrow 96. A similar sequence of steps is followed for accessing and removing merchandise from any lower enclosure in column 16. It will be appreciated that where a number of enclosures are nested above an enclosure from which merchandise is to be removed, all such enclosures may be raised in a single motion and pivoted together to expose the merchandise desired. Moreover, peripheral flange 46 of enclosure 14 may be rested on the lateral extension 50 or open upper end 58 of a lower adjacent enclosure 114, thus obviating the need to hold enclosure 14 (and any enclosures above enclosure 14) in the raised position during the time merchandise is being inserted into or removed from lower adjacent enclosure 114.

While the invention is susceptible to various modifications and alternative forms, specific embodiments have been shown and described by way of example in the foregoing drawings and description. However, it should be understood that the invention is not intended to be limited to the particular forms disclosed. Rather, the invention is intended to cover all modifications, equivalents and alternatives falling within the spirit and scope of the invention as defined by the appended claims.

I claim:

1. A merchandise display system comprising:

a support structure;

at least one elongated display bar mounted substantially vertically on the support structure; and a plurality of merchandise holders disposed in a column along the display bar, each merchandise holder including an end portion having an opening for receiving the display bar therethrough, a display portion extending substantially perpendicularly from the end portion and a retaining member, the display portion having substantially vertical sides for receiving and holding merchandise, the retaining member being configured to engage at least a portion of the sides of an adjacent holder in the column for maintaining alignment of the holders in the column to substantially enclose the adjacent holder, each merchandise holder being pivotable between a first position wherein the holder is aligned with at least one adjacent holder in the column, thereby preventing removal of merchandise, and a second position wherein the holder is angularly displaced with respect to at least one adjacent holder in the column, thereby permitting removal of merchandise.

2. A merchandise display system as recited in claim 1 wherein the sides of each merchandise holder extend vertically along substantially the entire height of the end portion of the holder.

3. A merchandise display system as recited in claim 1 wherein each merchandise holder includes four substantially vertical sides and an open upper end for receiving merchandise.

4. A merchandise display system as recited in claim 1 wherein each merchandise holder includes two mutually facing, spaced apart sides having arcuate recesses formed in the upper edge thereof for facilitating removal of merchandise from the holder.

5. A merchandise display system as recited in claim 1 wherein the retaining member of each merchandise holder is a peripheral flange extending substantially vertically from the bottom of the display portion of the holder whereby each merchandise holder is nested with an adjacent holder when in the first position.

6. A merchandise display system as recited in claim 1 wherein the retaining member of each merchandise holder is a peripheral flange extending substantially vertically around the bottom of the display portion and the end portion of the holder whereby each merchandise holder is nested with an adjacent holder in the column when in the first position.

7. A merchandise display system as recited in claim 1 wherein each merchandise holder is slidable along the display bar and is nested with an adjacent holder when in the first position, whereby each holder may be unnested from an adjacent holder by vertical displacement along the display bar prior to pivotal movement into the second position.

8. A merchandise display system as recited in claim 7, further comprising a locking mechanism mounted atop the support structure and selectively moveable between a locked position wherein vertical movement of the merchandise holders in the column is substantially prevented and an unlocked position wherein the merchandise holders may be displaced vertically along the display bar.

9. A merchandise display system as recited in claim 1 wherein each merchandise holder is made of a transparent, moldable plastic material.

10. A merchandise display system comprising:

a support frame;

at least one display bar disposed substantially vertically on the support frame; and a plurality of display enclosures disposed in a column along the display bar, each display enclosure including a hollow end portion for receiving the display bar therethrough, a merchandise display portion coupled to the end portion and extending substantially horizontally therefrom and a retaining member, each display portion including substantially vertical walls surrounding an internal display space and an open upper end for inserting merchandise into the display space and removing merchandise therefrom, each retaining member extending from the respective enclosure and being configured to engage at least a portion of the vertical walls of an adjacent enclosure in the column thereby substantially enclosing the adjacent enclosure and permitting the enclosures to be nestingly stacked, each enclosure being pivotable between a first position wherein the enclosure is nested with at least one adjacent enclosure in the column, thereby preventing removal of merchandise, and a second position wherein the enclosure is angularly displaced with respect to at least one adjacent enclosure in the column, thereby permitting removal of merchandise.

11. A merchandise display system as recited in claim 10 wherein the display portion of each enclosure includes two mutually facing, spaced apart sides having arcuate recesses formed in the upper edge thereof for facilitating removal of merchandise from the enclosure.

12. A merchandise display system as recited in claim 10 wherein the retaining member of each enclosure is a peripheral flange extending substantially vertically from the bottom of the display portion of the enclosure, whereby each enclosure is nested with an adjacent enclosure when in the first position.

13. A merchandise display system as recited in claim 10 wherein the retaining member of each enclosure is a peripheral flange extending substantially vertically around the bottom of the display portion and the end portion of the enclosure, whereby each enclosure is nested with an adjacent enclosure in the column when in the first position.

14. A merchandise display system as recited in claim 10 wherein each enclosure is slidable along the display bar, whereby each enclosure may be unnested from an adjacent enclosure by vertical displacement along the display bar prior to pivotal movement into the second position.

15. A merchandise display system as recited in claim 14, further comprising a locking mechanism mounted atop the support frame and selectively moveable between a locked position wherein vertical movement of the enclosures in the column is substantially prevented and an unlocked position wherein the enclosures may be displaced vertically along the display bar.

16. A merchandise display enclosure comprising:

an end portion having a substantially vertical, cylindrical bore for receiving a support bar therethrough and maintaining the enclosure pivotally on the support bar;

a display portion extending substantially horizontally from the end portion and having a bottom and sides surrounding an internal display space and an open upper end for receiving merchandise into the internal display space and removing of merchandise therefrom; and a retaining member configured to engage at least a portion of the sides of a similar display enclosure to substantially enclose the display space of the similar display enclosure and to permit alignment of display enclosures along the support bar.

17. A merchandise display enclosure as recited in claim 16 wherein the retaining member is a peripheral flange extending substantially vertically from the bottom of the display portion, whereby similar display enclosures may be nestingly retained in alignment along the support bar.

18. A merchandise display enclosure as recited in claim 16 wherein the retaining member is a peripheral flange extending substantially vertically around the bottom of the display portion and the end portion, whereby similar display enclosures may be nestingly retained in alignment along the support bar.

19. A merchandise display enclosure as recited in claim 16 wherein the end portion is configured to permit sliding movement along a support bar.

20. A merchandise display enclosure as recited in claim 16 wherein the enclosure is made of a transparent moldable material.

* * * * *